US007735677B2

(12) United States Patent
Harris

(10) Patent No.: US 7,735,677 B2
(45) Date of Patent: Jun. 15, 2010

(54) DRYWALL TOOLS STORAGE AND TRANSPORTATION CONTAINER

(76) Inventor: Rick L. Harris, 7374 E. Cr 700 N, Grandview, IN (US) 47615

( * ) Notice: Subject to any disclaimer, the term of this patent is extended or adjusted under 35 U.S.C. 154(b) by 709 days.

(21) Appl. No.: 11/481,072

(22) Filed: Jul. 5, 2006

(65) Prior Publication Data

US 2007/0056974 A1 Mar. 15, 2007

Related U.S. Application Data

(60) Provisional application No. 60/715,743, filed on Sep. 9, 2005.

(51) Int. Cl.
*B65D 25/04* (2006.01)
*B65D 85/00* (2006.01)

(52) U.S. Cl. ..... 220/533; 220/532; 206/373

(58) Field of Classification Search ..... 220/529, 220/532, 533, 554, 592.2; 206/207, 373
See application file for complete search history.

(56) References Cited

U.S. PATENT DOCUMENTS 3,581,930 A * 6/1971 Gunnink ..... 220/675
4,143,695 A * 3/1979 Hoehn ..... 220/826
4,499,998 A * 2/1985 Carlson ..... 206/541
4,593,816 A * 6/1986 Langenbeck ..... 206/425
5,259,215 A * 11/1993 Rocca ..... 62/371
5,526,929 A * 6/1996 Wei ..... 206/378
6,332,554 B1 * 12/2001 McCarthy ..... 220/554
6,626,006 B1 * 9/2003 Tedder ..... 62/457.7
7,410,094 B2 * 8/2008 Bos ..... 229/120.36
2002/0089894 A1 * 7/2002 Parlor, Sr. ..... 366/245
2005/0023282 A1 * 2/2005 Murrer ..... 220/592.2

* cited by examiner

*Primary Examiner*—Anthony Stashick
*Assistant Examiner*—Harry A Grosso
(74) *Attorney, Agent, or Firm*—Raymond M. Galasso; GaLasso & Associates, LP.

(57) ABSTRACT

Drywall Tools Storage and Transportation Container consists of a container having an outer main box with a lid, snaps for sealing the lid, a series of grommets on the top of the lid, molded handles on the top and bottom of the outer main box, wheels on the bottom of the main box, dividers placed within grooves in the interior of the main box, a water release valve on the bottom of the main box, a grate covering the floor of the main box, brackets in the interior, bottom of the main box, and at least one peg in the interior, bottom of the main box for holding a main pump. The invention allows a drywalling specialist to place his tools within the container for transport and storage when the tools are not in use. While working at a jobsite, certain tools can be placed within the grommets on the lid for ease of use. When the user has completed the job, he can simply place the tools within the container or on the brackets and dividers in the interior of the container and fill it with water. The user then closes the lid and uses the snaps on the lid to form a water-tight barrier, allowing the tools to be transported and cleaned through the agitation of the water while the container is moved between locations.

10 Claims, 1 Drawing Sheet

DRYWALL TOOLS STORAGE AND TRANSPORTATION CONTAINER

CROSS-REFERENCE TO RELATED APPLICATIONS

This Non-Provisional Patent Application claims priority to U.S. Provisional Patent Application No. 60/715,743 filed on Sep. 9, 2005 entitled "Drywall Tools Storage and Transportation Container."

FIELD OF THE DISCLOSURE

The disclosures made herein relate generally to the drywalling and spackling industry. The invention discussed herein is in the general classification of toolboxes and containers.

BACKGROUND

Gypsum is one of the most widely used minerals in the world with millions of pounds of gypsum consumed annually. A large percentage of the gypsum in the United States is used for making wallboard for homes, offices, and commercial buildings. Wallboard or plasterboard is a thin coat of plaster between two sheets of cardboard. The plaster is made from natural gypsum mined from quarries or from synthetic gypsum produced from scrubbing smokestacks in electrical power plants or from other industrial waste streams.

Many tools are used in conjunction with drywalling and spackling. Some of these include: taping heads, pumps, roller handles, glazing head handles, and bridger handles. After these tools are used, they need to be cleaned and stored for easy transport to other job sites. A thorough cleaning of these tools is imperative as they are often used in hostile environments such as the replacement of mildewed or mold-infested plasterboard.

Currently, no container is specifically made for transporting, cleaning and storing drywall tools. Buckets filled with water are often used to clean tools, however, this can lead to spills when the buckets are not covered. Buckets of water left uncovered can also easily freeze during winter months. Moreover, simply placing dirty tools into buckets of water does not adequately clean tools because water can easily spill out of the buckets before thoroughly cleaning the tools.

Conventional toolboxes and containers are not large enough for drywalling and spackling tools and do not have the ability to be drained when a user pours water inside to clean the tools. As a result, many expensive tools can be damaged or destroyed because of the inability to adequately care for these tools.

Hence, there is a need in the art for an easy to use, affordable, safe and sealable container for the transportation, storage and cleaning of drywall tools.

SUMMARY OF THE DISCLOSURE

Drywall Tools Storage and Transportation Container consists of at least some of the following: a container having an outer main box with a lid, snaps for sealing the lid, a series of grommets on the top of the lid, molded handles on the top and bottom of the outer main box, wheels on bottom of the main box, dividers placed within grooves in the interior of the main box, a water release valve on the bottom of the main box, a grate covering the floor of the main box, brackets in the interior, bottom of the main box, and at least one peg in the interior, bottom of the main box for holding a main drywall pump for mud.

The principal object of this invention is to provide a container that will allow individuals who are specialists in drywall maintenance to improve their skills by minimizing time loss and will allow for easy transport and storage of tools.

Another object of this invention is to provide an affordable container that will allow a drywall specialist to maintain expensive tools.

Another object of this invention is to provide a container that allows a professional to maintain a clean surrounding when repairing wallboard having mold, mildew or other deleterious materials.

Yet another object of this invention is to provide a sturdy, durable container capable of holding and transporting a large number of tools.

Yet another object of this invention is to provide a waterproof container that will not spill or allow the water inside to freeze on the way to a jobsite and will permit constant water flow for cleansing tools placed within the container.

DETAILED DESCRIPTION OF THE DRAWINGS

Drywall Tools Storage and Transportation Container utilizes at least some of the following: a container having an outer main box with a lid, snaps for sealing the lid, a series of grommets on the top of the lid, molded handles on the top and bottom of the outer main box, wheels on bottom of the main box, dividers placed within grooves in the interior of the main box, a water release valve on the bottom of the main box, a grate covering the floor of the main box, brackets in the interior, bottom of the main box, and at least one peg in the interior, bottom of the main box for holding a main pump. These components are described in further detail in conjunction with FIGS. 1-4.

Figure 1:
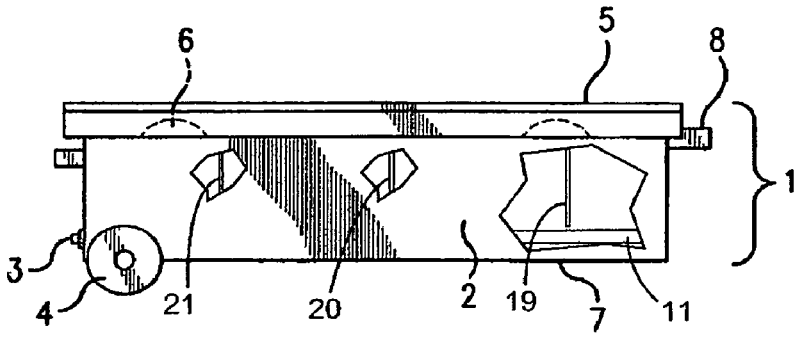
FIG. 1 depicts a side view of the preferred embodiment of the present invention.

FIG. 1 depicts a side view of the preferred embodiment of the present invention. The container 1 will have an overall basic shape of a three-dimensional rectangle. The specifications of the preferred embodiment of the container 1 are ten and a half inches in height, fifty-two and a half inches in length and fourteen inches in width. The main box 2 has a water release valve 3 (drain plug) placed at the bottom of the main box 2 and a main handle 8 at the top of the main box 2. The water release valve 3 is approximately three inches in diameter. A pair of wheels 4 located on the bottom of the main box 2 will allow for easy transport of the container 1. The wheels 4 are approximately six inches in diameter. A lid 5 with recessed handles 6 on both sides covers the main box 2.

At the bottom of the main box 2, approximately thirty nine to forty two inches from the top of the main box 2 and five inches from the floor 7 of the main box, an L-shaped bracket (not pictured) is located to hold one end of a taping head. On the floor 7 of the box, there is a peg (not pictured) that is four and a half inches tall and three quarters of an inch thick and located forty to forty-one and a half inches from the top of the main box 2. This peg will hold the main pump (not pictured) in place. There is also a small one inch square peg located twenty-seven to twenty eight inches from the top of the main box 2 to help hold the main pump in place.

Figure 2:
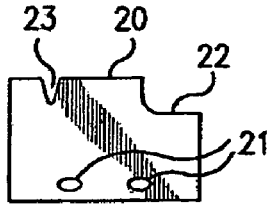
FIG. 2 depicts a side view of the fluid pass-thru dividers used in the present invention.
Figure 3:
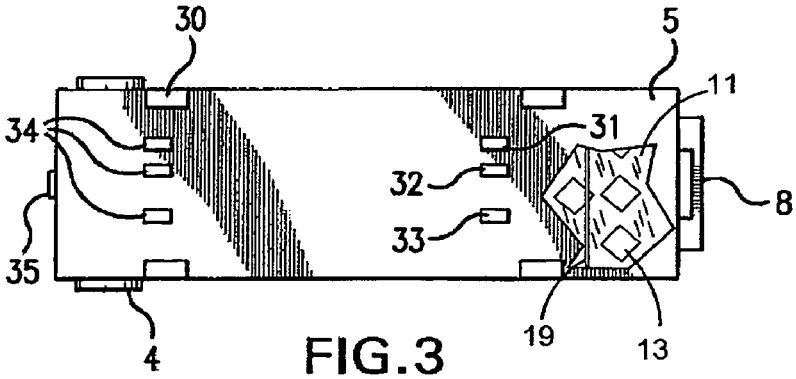
FIG. 3 depicts an overhead view of the preferred embodiment of the present invention.

The floor of the main box 2 has a false floor or grate 11 that has holes 13 to allow the debris from dirty tools (mud) to fall through it, as shown in the cutaway portions of the main box 2 in FIGS. 1 and 3. The grate 11 is removable to allow easy cleaning and approximately covers the entire floor 7 of the container 1. The grate 11 is approximately one inch in height. A set of three pass-thru dividers (19, 20, 21), as shown in the cutaway portions of FIGS. 1 and 3) are situated near the top and in the interior of the main box 2 as discussed in further detail in conjunction with FIG. 2.

FIG. 2 depicts a side view of one of the fluid pass-thru dividers used in the present invention. Referring to FIGS. 1-3, the three fluid pass thru dividers (19, 20, 21) are situated toward the top of the main box 2 and are removable therefrom. A first one of the fluid pass-thru dividers (i.e., the first fluid pass-thru divider 19) is spaced ten inches from the pump while a second one of the fluid pass-thru dividers (i.e., the second fluid pass-thru divider 20) is spaced six and one quarter inches apart from the first fluid pass-thru divider 19 and a third one of the fluid pass-thru dividers (i.e., the third fluid pass-thru divider 21) is spaced six and one quarter inches apart from the second fluid pass-thru divider 20. Each on of the fluid pass-thru dividers (19, 20, 21) has two holes 21 that are two inches in diameter that allow for water flow. One of the fluid pass-thru dividers (19, 20, 21) is used for dividing and holding the bridgers in place when the unit is held upright. The fluid pass-thru dividers (19, 20, 21) fit inside molded grooves in the sides of the main box 2. The fluid pass-thru dividers (19, 20, 21) each have a cup shaped slot 22 (shown in FIG. 2) that is two and three quarter inches wide and located two and a quarter inches from the side of the main box 2 and five inches from the bottom of the main box 2. The cup shaped slot 22 is used for holding the taping head. All three fluid pass thru-dividers (19, 20, 21) also have a second one inch groove 23 shown in FIG. 2) that is five and a half inches from the cup shaped slot 22. This groove 23 is used for holding a mixer paddle.

FIG. 3 depicts an overhead view of the preferred embodiment of the present invention. The container has four snaps 30 near each corner of the lid 5, allowing the lid 5 to seal. There is a first row of three grommets located eleven inches from the top of the container. The first grommet 31 is one inch apart from the second grommet 32. The third grommet 33 is spaced two and three quarters inch from the second grommet 32. A second row of grommets 34 is located thirty-two inches from the top of the container. This second row of grommets 34 also has three grommets located a corresponding width apart as the grommets in the first row. The purpose of the grommets is to carry a roller handle, a glazing head handle, and one bridger handle. Molded handles are located at both ends of the container to allow two men to load and unload the container. The main handle 8 is on the top of the container opposite the wheels 4. The second handle 35 is located on the bottom of the container.

Figure 4:
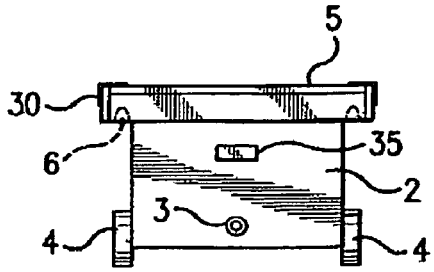
FIG. 4 depicts a bottom view of the preferred embodiment of the present invention.

FIG. 4 depicts a bottom view of the preferred embodiment of the present invention. The lid 5, main box 2, recessed handles 6, second handle 35, water release valve 3, snaps 30, and wheels 4 are all visible from the bottom view.

The invention works by allowing a drywalling specialist to simply place his tools within the container for transport and storage when the tools are not in use. The handles and wheels allow for easy transport of the entire container. While working at a jobsite, certain tools can be placed within the grommets on the lid for ease of use. When the user has completed the job, he can simply place the tools within the container or on the brackets and dividers in the interior of the container and fill it with water. The user then closes the lid and uses the snaps on the lid to form a water-tight barrier. The agitation of the water as the container is carried insures the tools are properly cleaned. After an appropriate amount of time lapses, the water release valve can be opened to drain the water from the container. The user can also periodically remove the grate from the bottom to clean it after it captures the debris removed from the tools.

The components of Drywall Tools Storage and Transportation Container may vary widely but will likely utilize metal, plastic, and rubber components. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Drywall Tools Storage and Transportation Container can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

The size of the Drywall Tools Storage and Transportation Container may vary widely. The preferred embodiment is approximately nine and a half inches in height, fifty-two and a half inches in length and fourteen inches in width. The preferred embodiment of the invention is also built to carry loads up to two hundred pounds. It should be obvious that any color, shape or size container could be utilized with the present invention.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A container comprising:

(a) a main box having top, bottom and side portions;

(b) a lid attached to the main box, wherein a width of the lid is greater than a width of the main box such that opposing side portions of the lid extend beyond respective side portions of the main box and wherein at least one recessed handle is accessible through a bottom surface of each one of said opposing side portions of the lid that extend beyond said respective side portions of the main body;

(c) a water release valve located at the bottom of the main box; and (d) a plurality of sets of grommets located on a top portion of the lid, wherein said sets of grommets are jointly configured for holding a roller handle, a glazing head handle, and a bridger handle, wherein a first one of said sets of grommets is located adjacent a first end portion of the lid and a second one of said sets of grommets is located adjacent a second end portion of the lid such that said sets of grommets are spaced apart from each other, wherein said grommets of the first one of said sets are spaced apart from each other in an identical manner as said grommets of the second set of said grommets, wherein each one of said grommets in the first one of said sets of grommets is longitudinally aligned with a corresponding one of said grommets in the second one of said sets of grommets.

2. The container of claim 1 wherein the main box is approximately rectangular.

3. The container of claim 1 further comprising a main handle on the top of the main box.

4. The container of claim 3 further comprising a second handle on the bottom of the main box.

5. The container of claim 1 further comprising a plurality of wheels located on the bottom of the main box.

6. The container of claim 1 wherein said recessed handles are accessibly only through the bottom surface of each one of said opposing side portions of the lid that extend beyond said respective side portions of the main box.

7. The container of claim 1 wherein the lid has a plurality of snaps to create an approximately water tight seal with the main box.

8. The container of claim 1 further comprising:

a pass-thru divider situated within an interior of the main box near the top the main box, wherein the pass-thru divider has at least one hole toward the bottom of the pass-thru divider; and a grate located within the interior of the main body between a bottom edge portion of the pass-through divider and a floor of the main box.

9. The container of claim 8 wherein:

the pass-thru divider has a cup shaped slot within a top edge portion thereof and a one inch groove within the top edge portion thereof;

said groove is positioned between opposing end portions of the pass-thru divider; and the cup shaped slot intersects one of said opposing end portions of the pass-thru divider.

10. A container comprising:

(a) a main box that is approximately rectangular with a main handle on the top of the main box and a second handle on the bottom of the main box;

(b) a lid with a plurality of recessed handles on the sides of the lid, a plurality of snaps for attaching the lid to the main box, and a plurality of sets of grommets located on a top portion of the lid, wherein said sets of grommets are jointly configured for holding a roller handle, a glazing head handle, and a bridger handle, wherein a first one of said sets of grommets is located adjacent a first end portion of the lid and a second one of said sets of grommets is located adjacent a second end portion of the lid such that said sets of grommets are spaced apart from each other, wherein said grommets of the first one of said sets are spaced apart from each other in an identical manner as said grommets of the second set of said grommets, wherein each one of said grommets in the first one of said sets of grommets is longitudinally aligned with a corresponding one of said grommets in the second one of said sets of grommets;

(c) a water release valve located at the bottom of main box;

(d) a first pass-thru divider having at least one hole at the bottom, wherein said pass-through divider is capable of being situated near the top and in the interior of the main box (e) a second pass-thru divider having at least one hole at the bottom, spaced away from the first pass-thru divider and in the interior of the main box;

(f) a third pass-thru divider having at least one hole at the bottom, spaced away from the second pass-thru divider and in the interior of the main box; and (g) a plurality of wheels located on the bottom of the main box;

(h) wherein each one of said pass-thru dividers has a cup shaped slot within a top edge portion thereof and a one inch groove within the top edge portion thereof, said groove is positioned between opposing end portions of a respective one of said pass-thru dividers, and the cup shaped slot intersects one of said opposing end portions of the respective one of said pass-thru dividers.

* * * * *